US005567063A

United States Patent [19]

Chiu

[11] Patent Number: 5,567,063

[45] Date of Patent: Oct. 22, 1996

[54] CORDLESS PRINTING HEAD CONTROL SYSTEM

[75] Inventor: Shun-Pui Chiu, Kowloon, Hong Kong

[73] Assignee: NK Techology Ltd., Hong Kong

[21] Appl. No.: 412,152

[22] Filed: Mar. 28, 1995

[51] Int. Cl.[6] ..... B41J 1/00

[52] U.S. Cl. ..... 400/174; 400/320

[58] Field of Search ..... 400/174, 175, 400/320, 124.04; 347/208–210

[56] References Cited

U.S. PATENT DOCUMENTS 4,709,248 11/1987 Piatt et al. ..... 400/175
5,039,237 8/1991 Tanuma ..... 400/157.3
5,245,922 9/1993 Klemm ..... 101/115
5,289,210 2/1994 Takayanagi ..... 400/175

*Primary Examiner*—Stephen R. Funk
*Assistant Examiner*—Steven S. Kelley
*Attorney, Agent, or Firm*—Burns, Doane, Swecker & Mathis

[57] ABSTRACT

A cordless printer head, for example of a bubble-jet or ink-jet printer, is provided with memory to allow it to store data to be printed and a control device for driving the printer head. This avoids the need for a continous data transmission to the printer head requiring a costly cable and associated space and other problems. Instead data to be printed can be downloaded to the printer head at intervals by a data transfer device provided at the end of the movement of the printer head.

16 Claims, 6 Drawing Sheets

FIG. 1
(PRIOR ART)
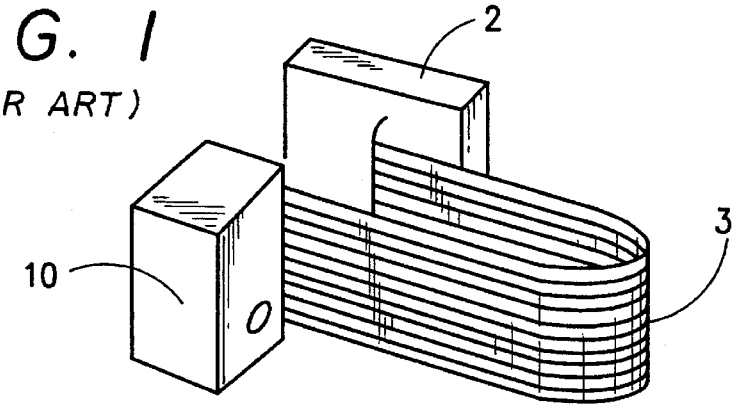
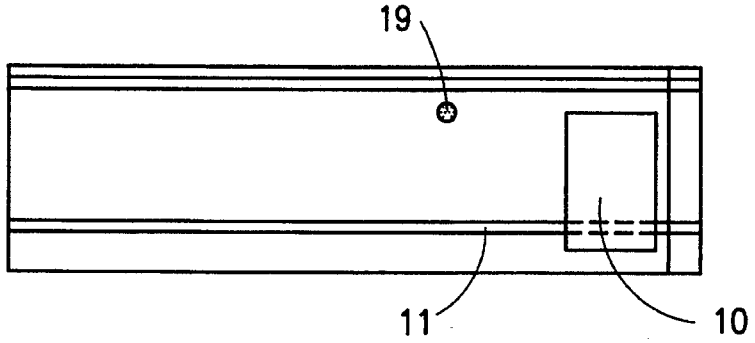
FIG. 2a
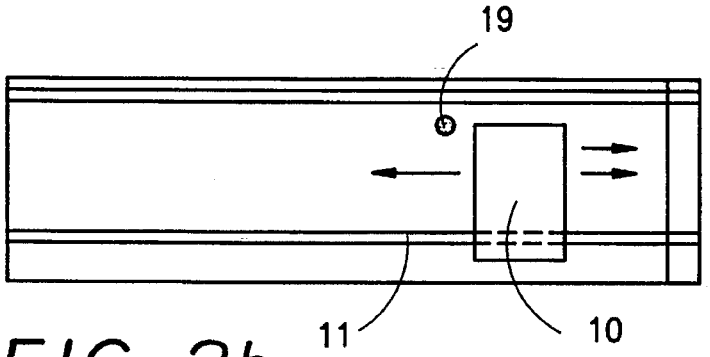
FIG. 2b
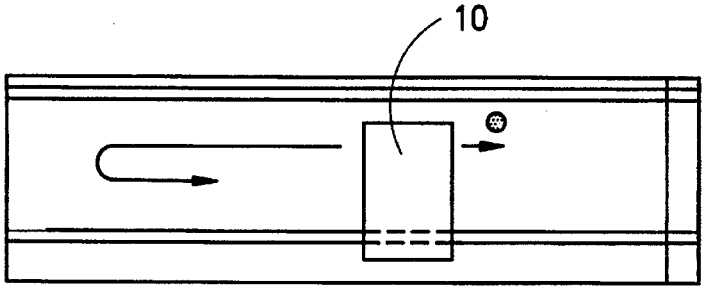
FIG. 2c

CORDLESS PRINTING HEAD CONTROL SYSTEM

FIELD OF THE INVENTION

This invention relates to a printing head, and in particular though not exclusively to a printing head for an ink-jet or bubble-jet printer.

BACKGROUND OF THE INVENTION

Ink-jet and bubble-jet printers have become in recent years increasingly popular in the high-volume and low-cost end of the printer market. They produce good quality prints at a relatively low cost compared to, for example, laser printers and as such they are well suited for small business and domestic users. However, there is scope for reducing further the cost and size of such printers.

A conventional ink-jet printer comprises a printer cartridge which is mounted on a carriage for movement to and fro across the width of the paper. The cartridge comprises a supply of ink and means for directing the ink from a plurality of fine nozzle outlets toward the paper. A number of other elements will also be provided either as part of the printer cartridge or the carriage. These include, for example, thermal elements for producing the ink-jets, paper sensing means, and position encoding means for determining the position of the carriage and the printer cartridge relative to the main body of the printer and the paper.

However, the main printer head control means, which tells the printer cartridge what to print and where depending on an input from an external source such as a personal computer, is located remote from the printer cartridge and is connected to the cartridge by a flexible cable. Depending on the number of print nozzle outlets provided in the cartridge, the flexible cable will require a large number of individual wires, as much as 50 or 60 or even more. Such cables are well known and the individual wires are generally disposed to form a flat wide cable.

These cables are, however, expensive and in the low-end of the printer market they represent a significant amount of the total cost of a printer. Furthermore because they connect to a moving printer head they must be quite long to allow for this movement and a substantial empty space must be left in the printer so as to allow the cable to move without obstruction as the printer head moves to and fro. This increases the size of the printer beyond what would otherwise be necessary and thus further increases the cost of the printer.

Such flexible cables present further difficulties. The individual wires tend to be very fine and can thus easily break, especially when subject to repeated bending as the printing head moves back and forth, and they are also subject to noise interference unless the cable is shielded, and shielding the cable further adds to the cost of a printer.

SUMMARY OF THE INVENTION

It would be desirable to provide a printer head control system that eliminated the need for any cable interconnecting the printer head with the main printer control means.

According to the present invention there is provided a printer comprising printer control means and a printer head, wherein said printer head comprises printer head drive control means and memory means for storing data to be printed, and wherein data transfer means are provided for transferring data from said printer control means to said memory means at intervals.

With such an arrangement the need for a connecting cable is eliminated. The printer head itself is provided with drive control means to operate the printer head and sufficient memory capacity to store a selected amount of data to be printed. At regular intervals the memory means provided on the printer head will be provided with new data from the main control means.

The memory means may have the capacity to store sufficient data to print one line and new data will be transferred to the memory means when the printer head reaches the end of its movement in one direction. However if the printer head is to print in both directions of movement, this would require data transfer means to be provided at each end of the movement of the printer head. Preferably therefore the memory is sufficient to store two lines and then it is only necessary to provide data transfer means at one end of the travel of the printer head.

Various forms of data transfer means are possible. Data may be transferred by a non-contact method, for example by electro-magnetic coupling, optical means, infra-red or microwave transmissions. Alternatively however the printer may be provided with electrical contact means adapted to engage with corresponding contact means formed on the printer body when the printer head reaches the end of its travel. While these contact means are in mutual engagement data may be downloaded from the main printer control means to the memory means formed on the printer head.

In a conventional printer the cable is also used for the power supply to the printer head. To completely eliminate such a cable connection an alternative means of supplying power must be provided. Preferably the printer head is mounted for movement along a shaft, the shaft being held at a first potential relative to a main frame portion of the printer body which is held at a second potential, and said printer head being provided with brush contacts for engaging said shaft and said frame portion. Thus the printer head may be supplied with power without requiring a power supply cable.

Such a power supply requires good mechanical connections and as such it may be subject to noise and occasional brief interruptions. To ensure a high quality power supply it may therefore be desirable to include in the power supply circuitry on the printer head filter means and temporary power storage means.

Preferably the data transfer means transfers not only data to be printed but also may permit one-way or two-way transfer of data concerning the position of the printing head and synchronization of the printing head with the drive means.

BRIEF DESCRIPTION OF THE DRAWINGS

Several embodiments of the invention will now be described by way of example and with reference to the accompanying drawings, in which:

FIG. 1 illustrates schematically a conventional arrangement employing a flexible cable connection, FIGS. 2(*a*)–(*c*) illustrates the movement of a printer head in accordance with the present invention with the transfer of data after every two lines printed, FIGS. 3(*a*)–(*d*) illustrate various possible means for transferring data to said printer head.

DETAILED DESCRIPTION OF PREFERRED EMBODIMENT

Figure 3A:
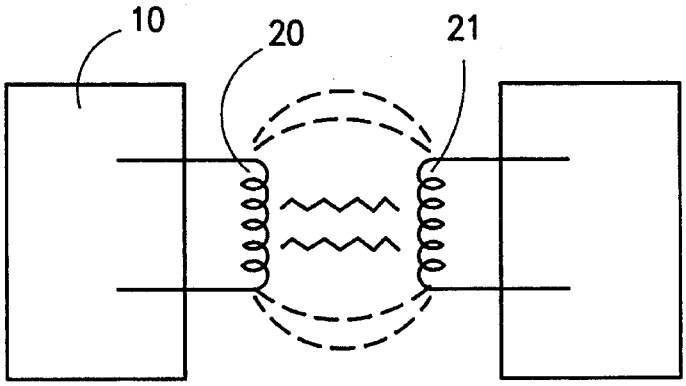
Figure 3B:
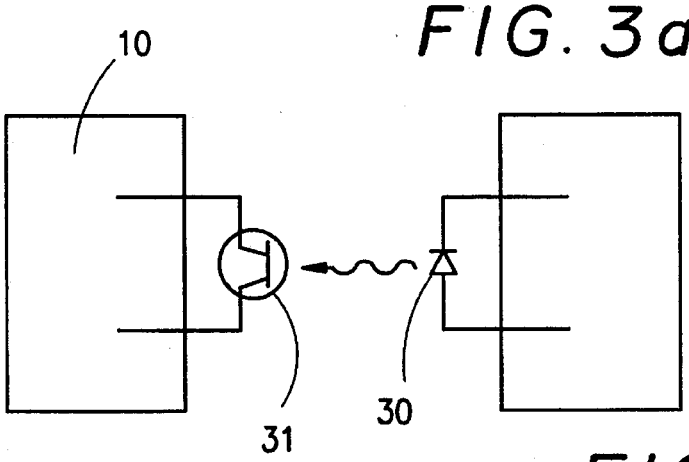
Figure 3C:
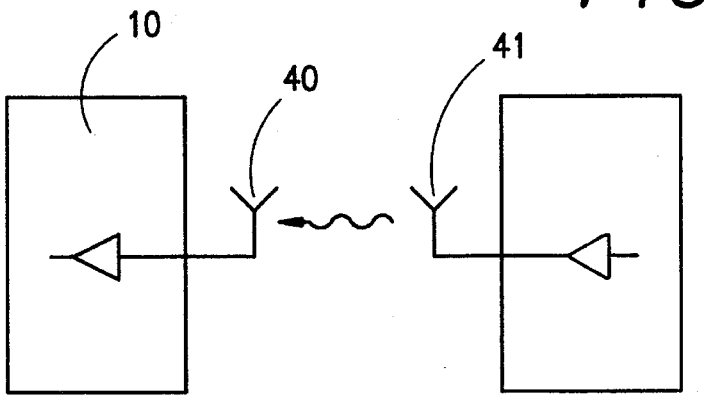
Figure 3D:
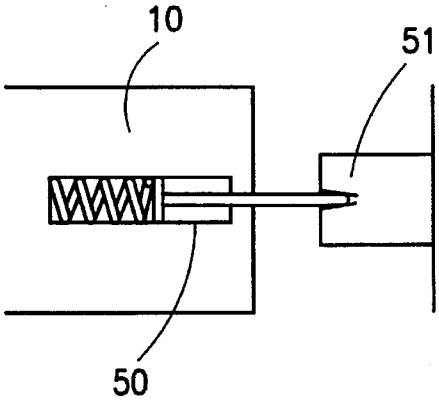

Referring firstly to FIG. 1 there is shown a conventional arrangement in which an ink-jet printing head 10 is connected to drive circuitry provided on printed circuit board 2 via a flexible connecting cable 3. Depending on the number of printing nozzles the flexible cable 3 may have as many as 60 (or even more) individual wires. These individual wires are laid out alongside each other so that a flat cable is produced. Such cables are well known and, as discussed above, are relatively expensive. Furthermore because the printer head must be free to move the cable must be relatively long and space must be provided in the printer for the cable so that it does not get caught on an internal part of the printer. As discussed above these all represent disadvantages, especially when it is desired to produce a cheap printer.

FIGS. 2(*a*)–(*c*) show the movement of a printer head according to an embodiment of the present invention. The printer head 10 is mounted for reference longitudinal movement along a shaft 11 back and forth. An index position 19 is also shown for illustration purpose. The extent of the movement of the printer head 10 is equal to at least the width of the paper to be printed on. As will described in further detail below the printer head carries with it memory means so that it can store a certain amount of data in order to print text or an image. Preferably the memory will be large enough to store sufficient data for the printer head to print while it traverses the width of the paper twice, ie once in one direction and once when returning. One end of the movement of the printer head 10 is defined as a home position 12. When the printer head 10 is at the home position 12 fresh data is transferred to the memory means of the printer head in a manner to be described further below. An index position 13 is also provided the function of which will also be described below.

FIGS. (*a*)–(*d*) show several alternative means for transferring data to the printer head 10 when the head is at the home position. FIG. 3(*a*) shows an electro-magnetic method in which data is transferred via input and output transformer coils 20,21 respectively. FIG. 3(*b*) shows an optical method in which data is transmitted by a light emitting diode 30 and received by a light sensor element 31. FIG. 3(*c*) shows a radio or microwave system in which data is transmitted and received by respective antennas 40,41. These all represent non-contact remote methods of data transmission.

FIG. 3(*d*) illustrates a preferred contact method of data transmission. The printer head is provided with spring-loaded contact pins 50 that engage corresponding contacts 51 provided at the home position. By spring-loading the contact pins abrupt contact between the printer head and the home position is avoided, and furthermore an extended period of contact is allowed which permits the transfer of data. Alternative mechanical contact systems are also possible, however. For example contact may be made by a brush or roller formed on the printer head engaging an extending shaft at the home position, or alternatively a contact pin on the printer head may be received between two extending contact arms.

Figure 4:
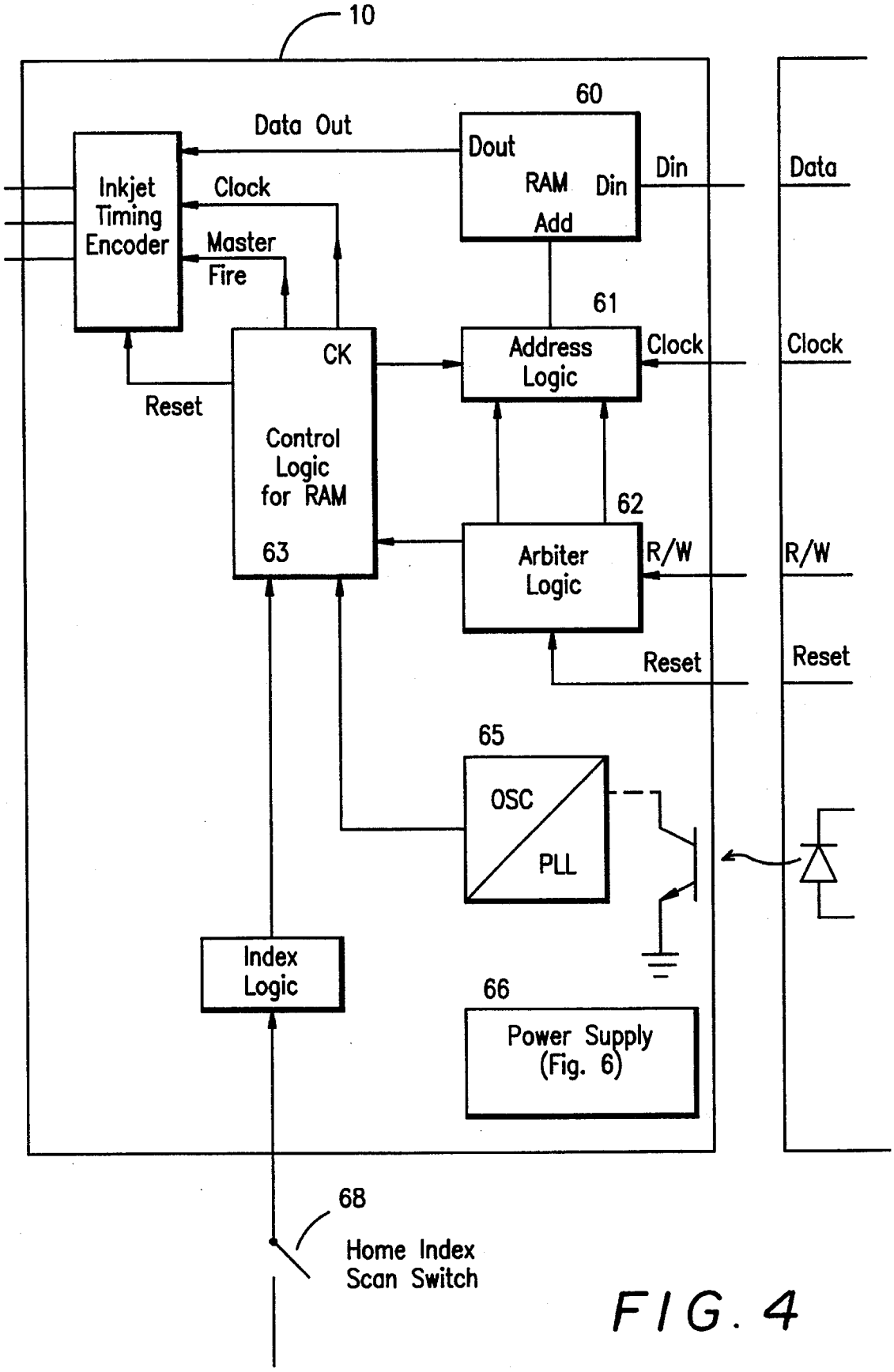
FIG. 4 is a block diagram illustrating the operation of a preferred embodiment of the invention.

FIG. 4 shows in more detail the operation of the invention. The printer head 10 includes a RAM memory 60 of sufficient capacity to store the data to be printed on at least one, and preferably two, traverses of the width of the paper. The printer-head 10 also includes all the necessary circuitry for driving the printer head to print this data. This additional circuitry includes address logic means 61, arbiter logic means 62, control logic means 63 for reading the RAM memory 60, and ink-jet timing encoder means 64. The printer head 10 may also include an optional synchronising oscillator 65 as will be discussed further below, and will include power supply control circuitry 66 which will also be described further below.

RAM memory 60, address logic means 61, and arbiter logic means 62 all receive inputs from the main printer control circuitry provided in the body of the printer via a chosen data transmission means of the types previously discussed with reference to FIGS. 3(*a*)–(*d*). Arbiter logic means 62 in fact receives two inputs, one being a reset signal. Together the RAM memory 60, address logic means 61 and arbiter logic means 62 comprises a "First-In-First-Out" logic means.

Also provided as part of the control means on the printer head is a synchronising oscillator 65 which acts as a master clock for the printer head. This may be either a free running clock pre-set at a fixed rate, or it can be a clock with a built-in phase lock loop operating in synchronization with the rest of the printer electronics, for example the printer head stepper motor. In addition the printer head is provided with-index logic means 67 which receives an input from a home index switch 68 to identify the position of the printer head.

Figure 5:
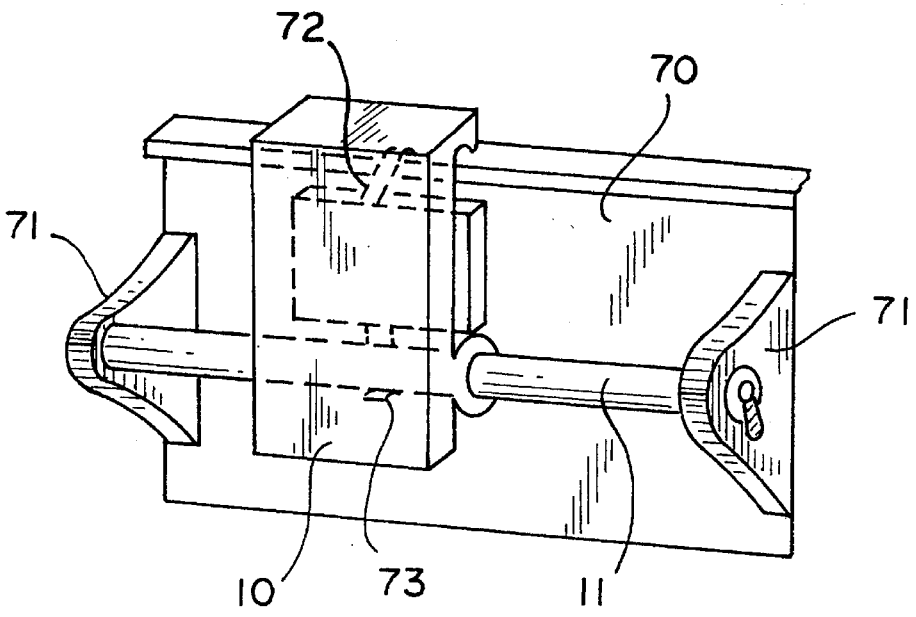
FIG. 5 shows a preferred power supply arrangement.
Figure 7A:
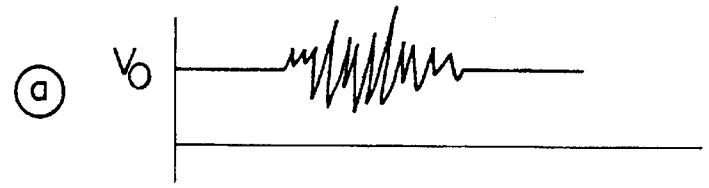
Figure 7B:
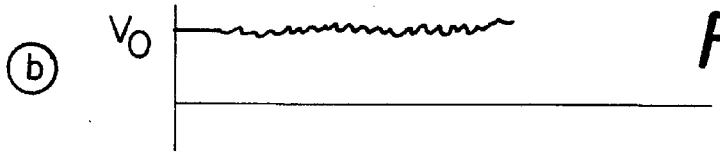
Figure 7C:
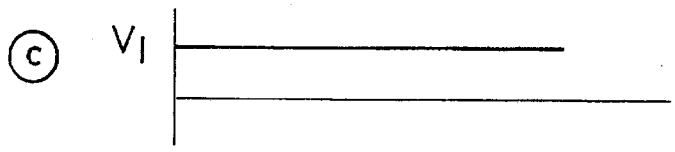
Figure 7D:
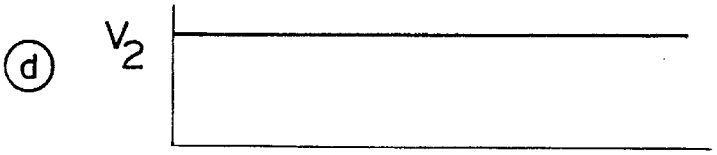
Figure 6:
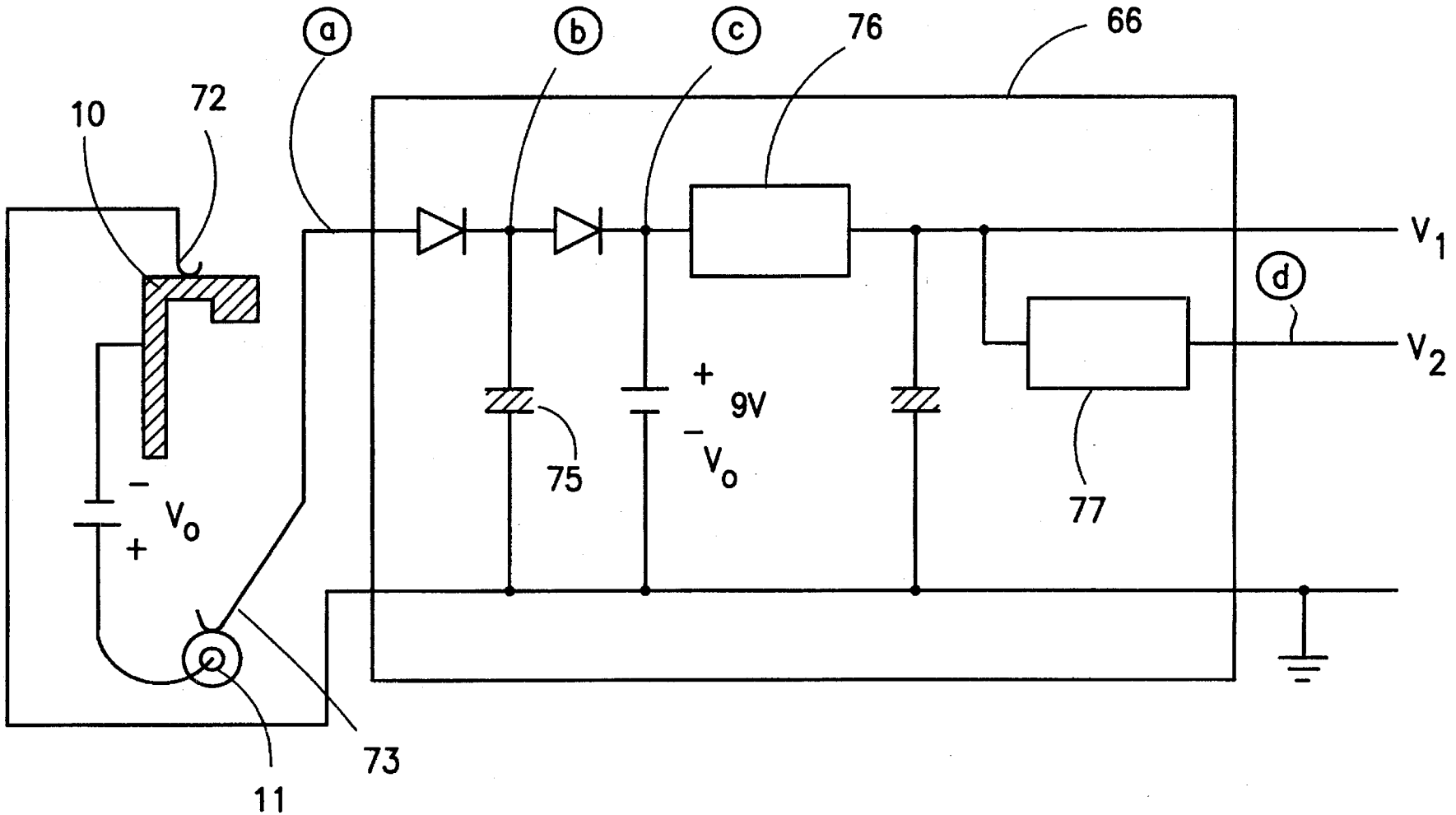
FIG. 6 is a circuit diagram for the power supply, FIGS. 7(*a*)–(*d*) show the effects of the circuit of FIG. 6 on the power supply.

The power supply will now be described in more detail and in particular with reference to FIGS. 5 & 6. Referring firstly to FIG. 5 a main frame portion 70 of the printer body is charged to a first potential, for example a negative potential, and the shaft 11 along which the printer head 10 reciprocates is charged to an opposite potential, for example a positive potential. The shaft 11 is mounted to the frame portion by means of insulating brackets 71. As previously discussed the printer head 10 moves to and fro along the shaft 11. The printer head 10 is provided with a pair of brush contacts 72,73 that contact the frame portion 70 and shaft 11 respectively to provide a supply of power to the printer head 10.

The brush connections mean, however, that the power supply is susceptible to noise and occasional interruption. To improve the quality of the power supply, therefore, there is provided smoothing circuitry on the printer head 10. This power supply control circuitry 66 is shown in FIGS. 6 & 4 and comprises a first filter stage 74 to reduce noise from poor mechanical connections. Filter stage 74 includes a capacitor 75 (e.g. 100 μF) which can also serve as a temporary power storage in the event of an interruption. In case of a longer power interruption the next stage in the power supply control circuitry comprises 9 V rechargeable batteries. The remaining stages comprise a regulator stage 76, and a voltage converter stage 77 which produces the desired final output. FIGS. 7(*a*)–(*d*) show the effect of these stages on the power supply voltage.

Figure 8:
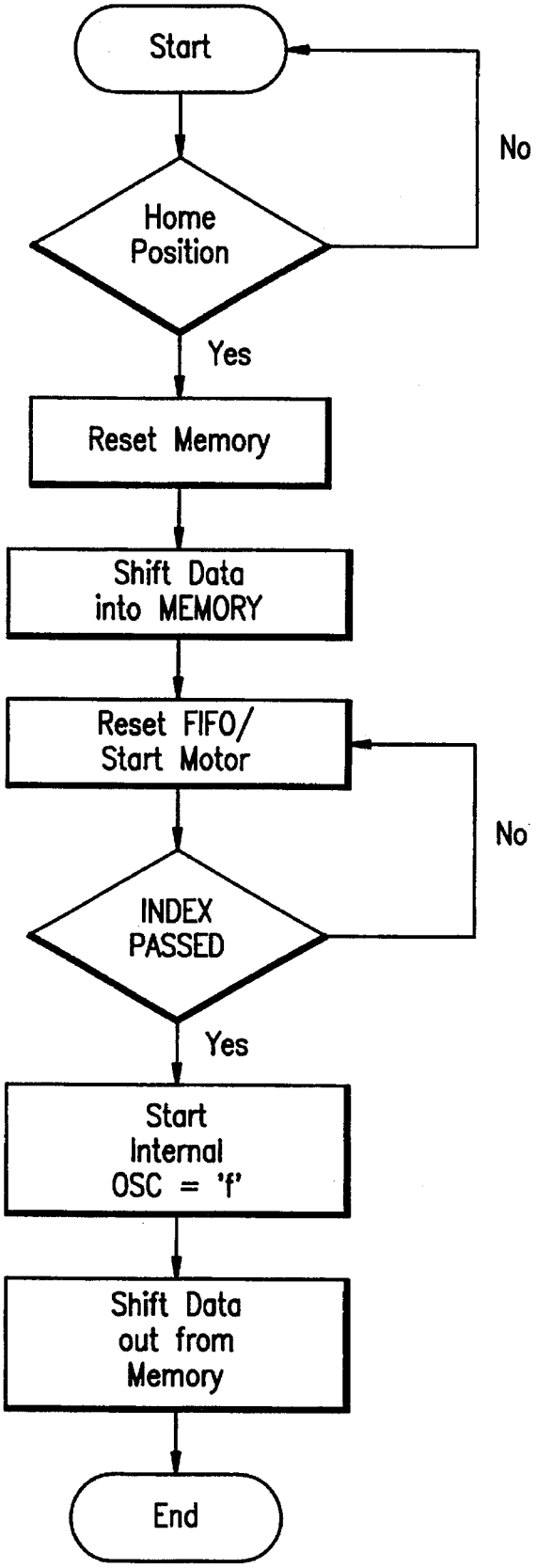
FIG. 8 is flow chart showing the transfer of data to the printer head.

Referring now to FIG. 8 the sequence of operation of the present invention will be described. The control means first asks the question 80 of whether the printer head 10 is at the home position. This question is repeated until a positive answer is obtained at which point the next step 81 is that the FIFO control means is reset, and in step 82 data is transferred from-the main control means of the printer to the RAM memory means on the printer head 10. This data is sufficient to allow the printer head to print while it travels at least one length and preferably two. Once the data has been transferred the FIFO is again reset (step 83) the stepper motor driving the printer head is restarted. When there is a positive answer to the question of whether the index position has been passed (step 84) the internal oscillator is started at a frequency f (step 85) and data is shifted from the FIFO RAM memory to the printer head encoder at a rate equal to f.

Thus it will be seen that by providing the printer head itself with at least some of the drive control means together with a minimum amount of memory the need for a continuous data transfer from the main printer control means to the printer head is avoided. Because of this there is no need for a cable connection to be provided and the need for a flexible cable with its associated problems can be avoided.

I claim:

1. A printer comprising printer control means and a cordless printer head, wherein said printer head comprises printer head drive control means and memory means for storing data to be printed, said memory means having sufficient capacity to store print data relating to at least one journey of the printer head across the width of the paper to be printed on, and wherein data transfer means are provided at least at one end of the movement of the printer head for transferring data from said printer control means to said memory means at intervals.

2. A printer as claimed in claims 1 wherein said memory means has sufficient capacity to allow the printer head to print while it makes one journey in one direction and a return journey in the opposite direction.

3. A printer as claimed in claim 1 wherein said data transfer means comprises a non-contact means.

4. A printer as claimed in claim 3 wherein said data transfer means comprises an electro-magnetic coupling.

5. A printer as claimed in claim 3 wherein said data transfer means comprises an optical transmission.

6. A printer as claimed in claim 3 wherein said data transfer means comprises an infra-red or microwave transmission.

7. A printer as claimed in claim 1 wherein said data transfer means comprises a contact means.

8. A printer as claimed in claim 7 wherein said printer head is provided with spring-biassed contact pins that engage corresponding contact portions formed as part of said data transfer means.

9. A printer as claimed in claim 1 wherein said printer head is adapted for movement along a shaft mounted on a frame portion of a main printer body, said shaft being held at a potential relative to said frame portion, and said printer head being provided with brush contacts for engaging said shaft and said frame portion.

10. A printer as claimed in claim 9 wherein said printer head is provided with power supply circuitry including noise filter means and temporary power storage means.

11. A printer as claimed in claim 1 wherein said data transfer means permits one-way or two-way transfer of data concerning the position of the printing head and synchronization of the printer head with printer head drive means.

12. A printer comprising a cordless printer head, a printer head drive mechanism for causing said printer head to traverse a recording medium on which information is to be printed, a memory in said printer head for storing print data relating to information to be printed while said printer head traverses a recording medium, and a data transfer device located at one end of the traverse of said printer head for transferring to said memory, when said printer head reaches said one end of the traverse, print data which relates to information to be printed during a subsequent traverse of the recording medium by the printer head.

13. The primer of claim 12 wherein said data transfer device includes means for transferring said data to said memory via non-contact data transmission.

14. The printer of claim 12 wherein said data transfer device includes means which temporarily contacts said printer head while the printer head is positioned at said one end of the traverse, and which is disengaged from said printer head while said printer head traverses a recording medium.

15. The primer of claim 12 wherein said memory stores print data relating to a single traverse of the recording medium by the printer head.

16. The printer of claim 12 wherein said memory stores print data relating to a traverse of the recording medium by the printer head in each of two opposite directions.

* * * * *